US011112737B2

(12) United States Patent
Morihara et al.

(10) Patent No.: US 11,112,737 B2
(45) Date of Patent: Sep. 7, 2021

(54) FIXING APPARATUS INCLUDING A HEAT CONDUCTING MEMBER WITH AN EXTENDING PORTION EXTENDING UPSTREAM OF THE HEATER

(71) Applicant: CANON KABUSHIKI KAISHA, Tokyo (JP)

(72) Inventors: Ryo Morihara, Tokyo (JP); Masahiko Suzumi, Yokohama (JP); Tomoo Akizuki, Kawasaki (JP); Tatsuya Kinukawa, Kawasaki (JP); Takeharu Nakada, Utsunomiya (JP); Akihito Kanamori, Yokohama (JP); Yusuke Nakazono, Yokohama (JP); Shinji Kubo, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/624,236

(22) PCT Filed: Apr. 12, 2018

(86) PCT No.: PCT/JP2018/015405
§ 371 (c)(1),
(2) Date: Dec. 18, 2019

(87) PCT Pub. No.: WO2019/003575
PCT Pub. Date: Jan. 3, 2019

(65) Prior Publication Data

US 2020/0192259 A1 Jun. 18, 2020

(30) Foreign Application Priority Data

Jun. 29, 2017 (JP) ..... JP2017-128001
Jun. 29, 2017 (JP) ..... JP2017-128002

(51) Int. Cl.
*G03G 15/20* (2006.01)
*G03G 21/16* (2006.01)

(52) U.S. Cl.
CPC ..... *G03G 15/2053* (2013.01); *G03G 15/2017* (2013.01); *G03G 21/1685* (2013.01); *G03G 2215/2035* (2013.01)

(58) Field of Classification Search
CPC ..... G03G 15/2053; G03G 15/2017; G03G 21/1685; G03G 2215/2035
See application file for complete search history.

(56) References Cited

U.S. PATENT DOCUMENTS

2010/0329753 A1 12/2010 Pawlik
2014/0003847 A1* 1/2014 Nishida ..... G03G 15/2017 399/329

(Continued)

FOREIGN PATENT DOCUMENTS

EP 1995646 A2 11/2008
JP 2003-257592 A 9/2003

(Continued)

*Primary Examiner* — Joseph S Wong
(74) *Attorney, Agent, or Firm* — Canon U.S.A., Inc. IP Division

(57) ABSTRACT

A fixing apparatus includes a tubular film, an elongate plate-like heater including a first surface in contact with an inner surface of the film and a second surface opposite to the first surface, the heater being in contact with the inner surface of the film with the second surface, a heat conducting member that is long along the length of the heater and is in contact with the second surface of the heater, and a support member capable of rotating the film while supporting the heater, with the heat conducting member therebetween. The heat conducting member includes an extending portion extending, outside an upstream end of the heater in a rotational direction of the film, in a direction from the second surface of the heater toward the first surface. The (Continued)

extending portion includes a contact portion protruding from the first surface of the heater toward the film into contact therewith.

11 Claims, 15 Drawing Sheets

(56) References Cited

U.S. PATENT DOCUMENTS

| | | | | |
|---|---|---|---|---|
| 2015/0139707 | A1* | 5/2015 | Suzumi | G03G 15/2042 399/329 |
| 2017/0031284 | A1 | 2/2017 | Ogawa | |
| 2018/0373186 | A1* | 12/2018 | Sato | G03G 15/2053 |
| 2019/0302664 | A1* | 10/2019 | Morihara | G03G 15/2053 |

FOREIGN PATENT DOCUMENTS

| | | | |
|---|---|---|---|
| JP | 2010-091665 | A | 4/2010 |
| JP | 2016-071284 | A | 5/2016 |

* cited by examiner

FIXING APPARATUS INCLUDING A HEAT CONDUCTING MEMBER WITH AN EXTENDING PORTION EXTENDING UPSTREAM OF THE HEATER

TECHNICAL FIELD

The present disclosure relates to a fixing apparatus for use in image forming apparatuses, such as electrophotographic copying machines and laser printers.

BACKGROUND ART

The following configuration is known as the configuration of fixing apparatuses for use in electrophotographic image forming apparatuses. This configuration includes a tubular film, a heater in contact with the film, and a pressure roller that forms a nip together with the heater, with the film therebetween. A printing material that carries an unfixed toner image is heated at the nip while being conveyed, so that the toner image is fixed to the printing material.

When the film of the fixing apparatus is rotated at high speed to cope with high-speed printing, heat supply from the heater to the film cannot be sometimes completed in time, and a configuration is disclosed in which heat can be transferred from the heater to the film also from other than the surface of the heater in contact with the film (PTL 1). Specifically, a heat conducting member (metal plate) is in contact with a surface of the heater opposite to the surface in contact with the film, and the heat conducting member is in contact with the film. This configuration enables higher speed fixing processing.

However, a fixing apparatus that can transfer heat from the heater to the film at still higher speed is required.

CITATION LIST

Patent Literature

[PTL 1]
Japanese Patent Laid-Open No. 2003-257592

SUMMARY OF INVENTION

Technical Problem

A fixing apparatus for solving the above problem according to an aspect of the present disclosure is configured to heat a toner image to fix the toner image to a printing material. The apparatus includes a tubular film, an elongate plate-like heater, a heat conducting member, and a support member. The elongate plate-like heater includes a first surface in contact with an inner surface of the film and a second surface opposite to the first surface. The heat conducting member is long in a longitudinal direction of the heater and is in contact with the second surface of the heater. The support member is capable of rotating the film while supporting the heater, with the heat conducting member therebetween. The heat conducting member includes an extending portion extending, outside an upstream end of the heater in a rotational direction of the film, in a direction from the second surface of the heater toward the first surface. The extending portion includes a contact portion protruding from the first surface of the heater toward the film into contact with the film.

Further features of the present invention will become apparent from the following description of exemplary embodiments with reference to the attached drawings.

DESCRIPTION OF EMBODIMENTS

First Embodiment

A fixing apparatus according to a first embodiment of the present disclosure will be described hereinbelow with reference to the drawings. First, the overall configuration of an image forming apparatus of the present embodiment will be described, and then the fixing apparatus will be described.

[Image Forming Apparatus Main Body]

Figure 1:
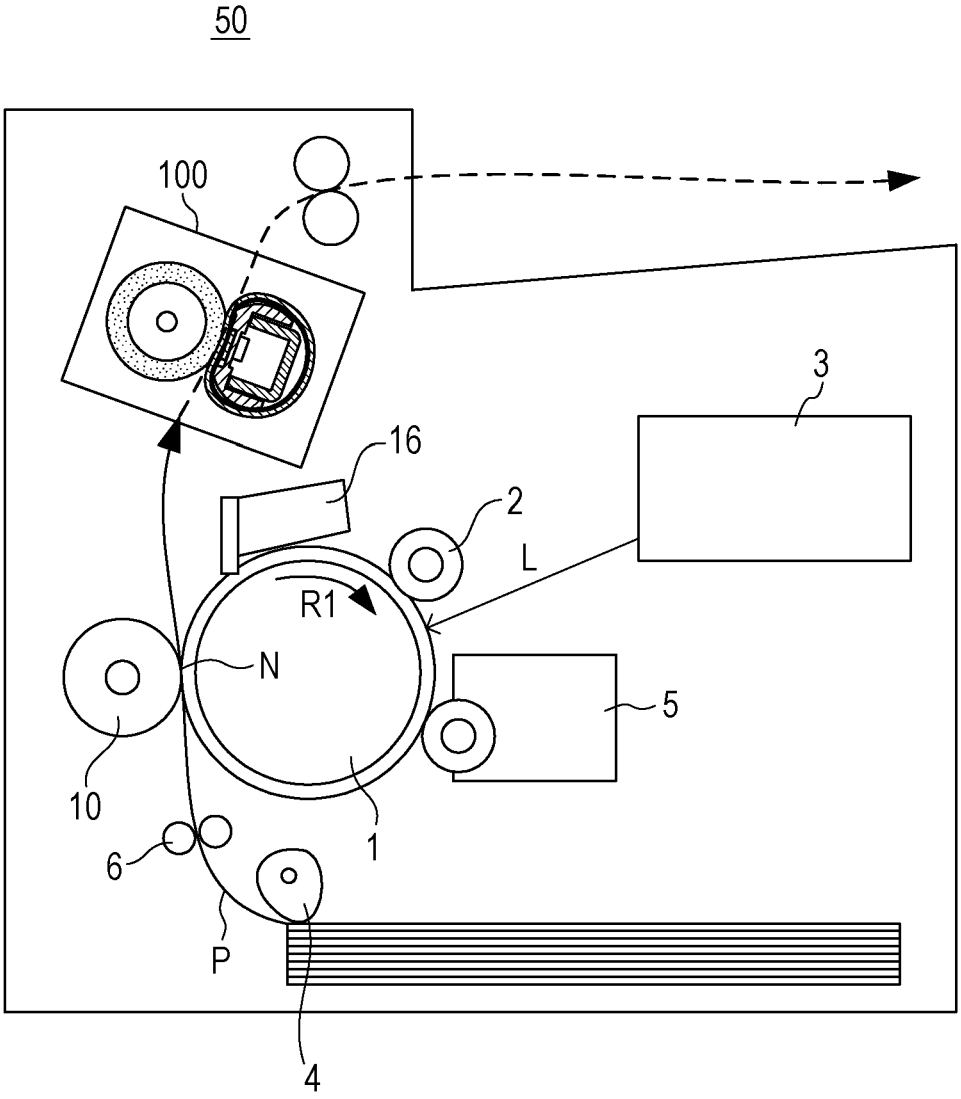
FIG. 1 is a schematic cross-sectional view of an image forming apparatus according to a first embodiment of the present disclosure.

In the present embodiment, an example of a method for forming an unfixed toner image on a printing material and the image forming apparatus will be described with reference to a schematic diagram illustrated in FIG. 1. An image forming apparatus 50 of the present embodiment is an electrophotographic image forming apparatus that directly transfers a toner image on a photosensitive drum 1 onto a printing material P. A charger 2, an exposure unit 3 that applies a laser beam L to the photosensitive drum 1, a developing unit 5, a transfer roller 10, and a photosensitive drum cleaner 16 are disposed on the circumferential surface of the photosensitive drum 1, which is an image bearing member, along a rotational direction (the direction of arrow R1). First, the surface of the photosensitive drum 1 is charged to minus polarity by the charger 2. Next, a static latent image is formed on the surface of the charged photosensitive drum 1 by the laser beam L from the exposure unit 3 (the exposed portion increases in surface potential). The toner of the present embodiment is charged in minus polarity, so that the minus toner is attached only to the static latent image portion on the photosensitive drum 1 by the developing unit 5 containing the black toner to form a toner image on the photosensitive drum 1. When the printing material P is fed by a paper feed roller 4, the printing material P is conveyed to a transfer nip N by a conveying roller pair 6. A transfer bias with plus polarity, which is opposite to the polarity of the toner, is applied to the transfer roller 10 from a power source (not illustrated), so that the toner image on the photosensitive drum 1 is transferred onto the printing material P at the transfer nip N. A transfer residual toner on the surface of the photosensitive drum 1 after the transfer is removed by the photosensitive drum cleaner 16 including an elastic blade. The printing material P carrying the toner image is conveyed to a fixing apparatus 100, in which the toner image on the surface is thermally fixed.

(Fixing Apparatus)

Figure 2:
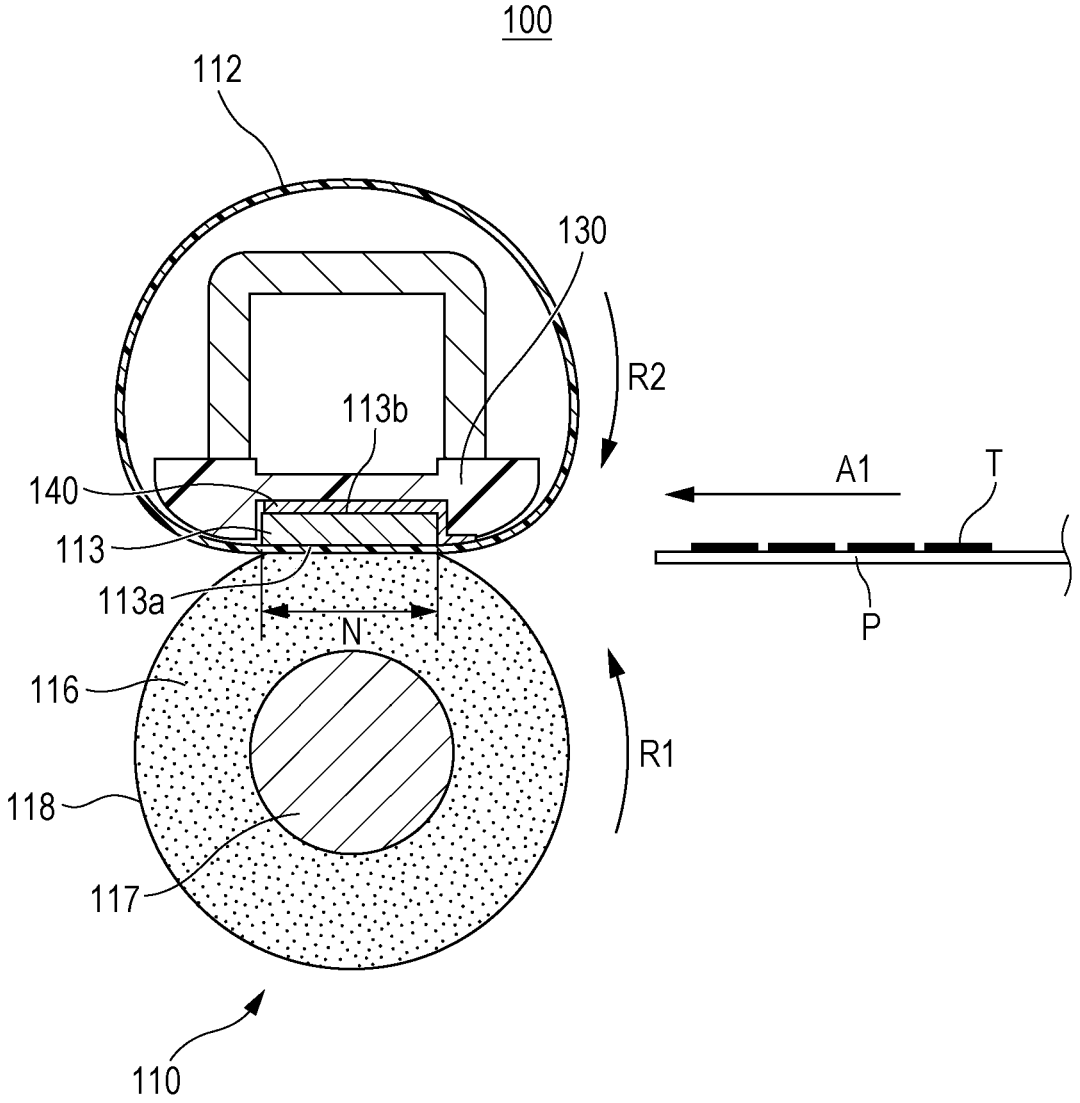
FIG. 2 is a schematic cross-sectional view of a fixing apparatus according to the first embodiment.

The fixing apparatus 100 of the present embodiment will be described hereinbelow. FIG. 2 is a cross-sectional view of the fixing apparatus 100 in the present embodiment.

The fixing apparatus 100 includes a fixing film 112, a heater 113, a heater holder 130, a pressure roller 110, and a heat conducting member 140.

The heater 113 is in contact with the inner surface of the fixing film 112 to heat the fixing film 112. The pressure roller 110 forms a nip N together with the heater 113, with the fixing film 112 therebetween. When the pressure roller 110 is driven in the direction of arrow R1 in the drawing, the fixing film 112 is rotated in the direction of arrow R2 by receiving a frictional force at the nip N from the pressure roller 110. When the printing material P to which an unfixed toner image T is transferred is conveyed from the direction of arrow A1 in the drawing to the nip N, the toner image T is thermally fixed to the printing material P.

The fixing film 112 will be described. The tubular fixing film 112 is configured so as to be rotatable and has a cylindrical shape with an outside diameter of 18 mm under no external force. The fixing film 112 has a multilayer configuration in the thickness direction. The fixing film 112 includes abase layer and a releasing layer formed on the outside of the base layer. The material of the base layer is metal, such as stainless steel or nickel, or a heat-resistant resin, such as polyimide, in consideration of heat resistance and rigidity. In the present embodiment, a polyimide resin is used as the material of the base layer of the fixing film 112, to which a carbon-based filler is added to increase the heat conductivity and strength. The thinner the base layer, the easier the heat from the heater 113 is transferred to the surface of the fixing film 112. However, this decreases its strength, and therefore, the thickness is preferably about between 15 μm and 100 μm, and in the present embodiment, it is set at 50 μm. The material of the releasing layer may be fluororesin, such as a perfluoroalkoxy (PFA) resin, a polytetrafluoroethylene (PTFE), or a tetrafluoroethylene-hexafluoropropylene (FEP) resin. In the present embodiment, PFA, which has high releasability and heat resistance among fluororesins, is used. The releasing layer may be a coating tube or a coat of paint. In the present embodiment, the releasing layer is made of a coat having a good thin-wall molding characteristic. The thinner the releasing layer, the easier the heat from the heater 113 is transferred to the surface of the fixing film 112. However, if the release layer is too thin, its durability decreases. For that reason, the thickness is preferably about between 5 μm and 30 μm. In the present embodiment, the thickness is set at 10 μm. An elastic layer may be disposed between the base layer and the releasing layer, although it is not provided in the present embodiment. In this case, the material of the elastic layer is silicone rubber or fluororubber.

The pressure roller 110 will be described. The pressure roller 110 has an outside diameter of 20 mm and includes a metal core 117 with a diameter of 12 mm and an elastic layer 116 with a thickness of 4 mm formed on the metal core 117.

The material of the elastic layer 116 is solid rubber or foamed rubber. The foamed rubber has low heat capacity and low heat conductivity, so that the heat of the surface of the pressure roller 110 is hardly absorbed into the inside. This has an advantage in that the surface temperature tends to rise, reducing the rise time. In the present embodiment, foamed silicone rubber is used. The smaller the outside diameter of the pressure roller 110, the smaller the heat capacity is. However, a too small diameter causes a decrease in the width of the pressure nip N, and therefore an appropriate diameter is needed. In the present embodiment, the outside diameter is set at 20 mm. Also for the thickness of the elastic layer 116, a too small thickness causes the heat to escape to the metal core 117, and therefore an appropriate thickness is needed. In the present embodiment, the thickness of the elastic layer 116 is set at 4 mm. A releasing layer 118 made of a perfluoroalkoxy (PFA) resin is formed on the elastic layer 116 as a toner releasing layer. The releasing layer 118 may be a coating tube or a coat of paint, like the releasing layer of the fixing film 112. In the present embodiment, a tube having high durability is used. The material of the releasing layer 118 may be not only PFA but also a fluororesin, such as PTFE, FEP, or fluororubber or silicone rubber having high releasability. The lower the surface hardness of the pressure roller 110, the larger the width of the nip N. In the present embodiment, pressure rollers 110 at three levels of 48°, 50°, and 52° of Asker-C hardness (load: 4.9 N) were used to verify the relationship between variations in the width of the nip N (described later) and the heat conduction of the heat conducting member 140. The pressure roller 110 is pressed to the heater 113 by a pressure unit (not illustrated). Also for the pressing force, a total pressure of three levels of 13 kgf, 14 kgf, and 15 kgf were used to verify the variations of the nip N (described later) and the heat conduction of the heat conducting member 140. The pressure roller 110 is configured to be rotated in the direction of arrow R1 at a surface moving speed of 200 mm/sec by a rotating unit (not illustrated).

The heater 113 will be described. The heater 113 is a heater in which a heating resistor is disposed on a substrate made of ceramic, such as alumina or aluminum nitride. The heater 113 is an elongate plate-like member having a first surface 113*a* in contact with the inner surface of the fixing film 112 and a second surface 113*b* opposite to the first surface 113*a*. The heater 113 is a heater in which the surface of an alumina substrate with a width of 6 mm in the printing-material conveying direction and a thickness of 1 mm is coated with a heating resistor made of Ag/Pd (silver-palladium) having a thickness of 10 μm by screen printing, on which 50-μm thick glass serving as a heating-element protecting layer is disposed.

The heater holder 130 will be described. The heater holder 130 is a support member that supports the second surface 113*b* of the heater 113. The heater holder 130 is made of liquid crystal polymer, which is a heat resistant resin, or the like.

Figure 3A:
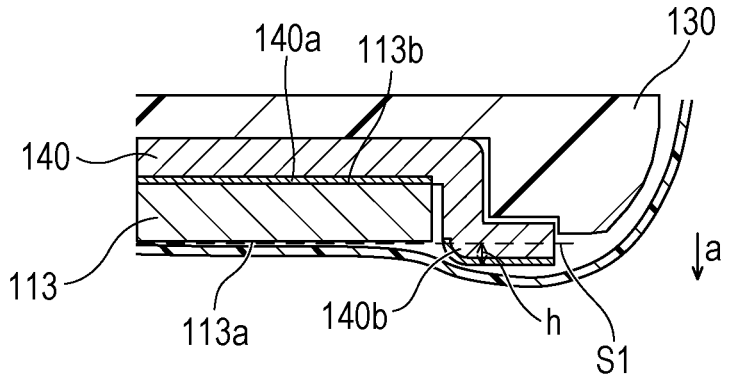
FIG. 3A is a schematic cross-sectional view of a heat transfer member and a heater according to the first embodiment illustrating the positional relationship therebetween.
Figure 3B:
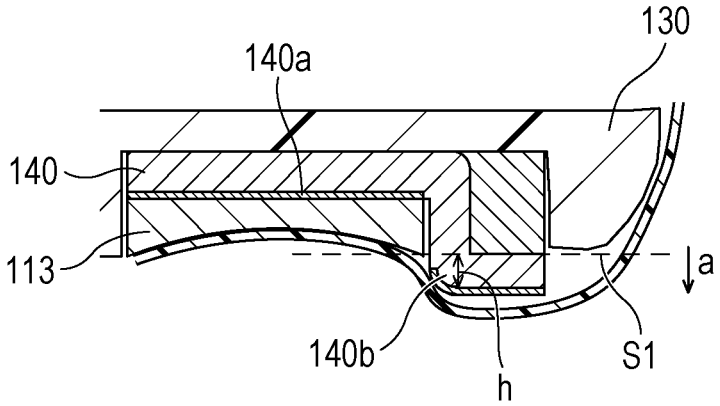
FIG. 3B is a schematic cross-sectional view of a heat transfer member and a heater according to the first embodiment illustrating the positional relationship therebetween.

The heat conducting member 140, which is a feature of the present embodiment, will be described. FIGS. 3A and 3B are schematic cross-sectional views of the heater 113 and the heat conducting member 140 perpendicular to the length of the heater 113, illustrating the positional relationship therebetween in enlarged view. The heat conducting member 140 is a member that is long in the longitudinal direction of the heater 113 and is disposed between the heater 113 and the heater holder 130 so as to be in contact with the second surface 113*b* of the heater 113, as illustrated in FIG. 3A. A portion of the heat conducting member 140 in contact with the second surface 113*b* of the heater 113 is referred to as a heater contact portion 140*a*. The heat conducting member 140 further includes an extending portion 140*b* extending, outside an end of the heater 113 in the rotational direction of the fixing film 112 (a printing-material conveying direction), from the second surface 113*b* of the heater 113 toward the first surface 113*a* into contact with the fixing film 112. The extending portion 140*b* protrudes toward the fixing film 112 more than the first surface 113*a* of the heater 113. The heater contact portion 140*a* may be in contact with any surface of the heater 113 other than the sliding surface. In the present embodiment, the heater contact portion 140*a* is in contact with the second surface 113*b* of the heater 113. Since the heat conducting member 140 is in contact with the second surface 113*b* of the heater 113, the heat conducting member 140 can be in contact with a large area of the heater 113. This offers the advantage that good adhesion due to the pressure force from the pressure roller 110 can be obtained. In the present embodiment, the heat conducting member 140 has a two-step bent (Z-shape) cross section, as illustrated in FIG. 3A. Alternatively, the heat conducting member 140 may have a one-step bent (L-shape) cross section, as illustrated in FIG. 3B. The material of the heat conducting member 140 is only required to have higher heat conductivity than that of the substrate of the heater 113, and preferably has a heat conductivity of 100 watt per meter-kelvin or higher. In the present embodiment, an aluminum alloy having a heat conductivity of about 140 watt per meter-kelvin was used.

Next, the definition of the protrusion amount h of the extending portion 140*b* will be described with reference to FIG. 3A. Let S1 be a line extending from the first surface 113*a* of the heater 113 to the upstream side in the printing-material conveying direction. Let a be a direction perpendicular to the first surface 113*a* of the heater 113 and directed from the second surface 113*b* to the first surface 113*a*. The maximum value of protrusion of the end of the extending portion 140*b* is defined as the protrusion amount h, which is 0 when the end is on the line S1, positive when the end protrudes in the direction of arrow a, and negative when the end does no protrude from the first surface 113*a*. In the present embodiment, the first surface 113*a* of the heater 113 is flat, but this is given for mere illustration. As illustrated in FIG. 3B, the first surface 113*a* may be curved or inclined. In this case, a line passing through a portion of the heater 113 protruding most toward the pressure roller 110 at an end of the heater 113 in the crosswise direction (printing-material conveying direction) and parallel to the first surface 113*a* of the heater 113 is defined as S1, and the protrusion amount h is defined with respect to the line S1.

In order to stably transfer heat from the heater 113 to the fixing film 112 through the extending portion 140*b*, it is important to configure the extending portion 140*b* and the fixing film 112 so that the state of contact therebetween is stabilized. In the present embodiment, the contact state between the extending portion 140*b* and the fixing film 112 is stabilized by providing the protrusion amount h.

In the present embodiment, the contact state between the extending portion 140*b* and the fixing film 112 was evaluated under the following three conditions. The first condition is that the pressing force at the nip N is small, and the roller hardness is high, so that the width of the nip N is decreased (pressing force: 13 kgf, roller hardness: 52°, pressure nip width: 5 mm). The second condition is that the pressing force at the nip N is large, and the roller hardness is low, so that the width of the nip N is increased (pressing force: 15 kgf, roller hardness: 48°, nip width: 7 mm). The third condition is that both of the pressing force at the nip N and the roller hardness are intermediate values of the values of the above conditions (pressing force: 14 kgf, roller hardness: 50°, nip width: 6 mm). The stability of the contact state between the extending portion 140*b* and the film 112 was evaluated under the above three conditions.

A method of evaluation will be described. The evaluation was conducted in an environment of a room temperature of 23° C. and a relative humidity of 50%. The heater 113 is left for about one hour without being supplied with electric power, and a sheet of paper with a stripe image (2-dot/3-space) was passed to check fixing unevenness. The paper used was XEROX Vitality (75 g/m$^2$, LTR).

In the present embodiment, the heat conducting member 140 having a protrusion amount h of 100 μm was used for evaluation. For comparison, Comparative Example 1 in which the protrusion amount h of the heat conducting member is −100 μm and Comparative Example 2 in which the protrusion amount is 0 μm were used.

The results of comparison under the above conditions are shown in Table 1. First, in Comparative Example 1 in which the protrusion amount h is −100 μm, fixing unevenness was exhibited at all the nip widths. This is because, when the track of the fixing film 112 in the vicinity of the nip N bends in a direction opposite to the pressure roller 110, the extending portion 140*b* and the fixing film 112 are brought into contact with each other to transfer heat, but when the fixing film 112 bends toward the pressure roller 110, the extending portion 140*b* and the fixing film 112 do not come into contact with each other, so that heat is not transferred. Next, in Comparative Example 2 in which the protrusion amount h is 0 μm, when the width of the nip is 7 mm, the fixing unevenness was reduced to a trouble-free level. This is because the width of the heater 113 smaller than the width of the nip N causes the extending portion 140*b* and the inner surface of the fixing film 112 to come into contact al the time at the nip N in the vicinity of the heater 113 to enable heat transfer. However, in the cases where the pressure nip width is 6 mm and 5 mm, fixing unevenness occurred for the same reason as in Comparative Example 1. Finally, in the embodiment in which the protrusion amount h was 100 μm, the fixing unevenness was reduced to a problem-free level at all the widths of the nip N. This is because the large protrusion of the extending portion 140*b* allows the protrusion amount h of the extending portion 140*b* to be larger than the amount of change of the track of the fixing film 112, so that even when the track of the fixing film 112 changes, the contact between the extending portion 140*b* and the inner surface of the film 112 is kept.

TABLE 1

| | Nip width: 5 mm | Nip width: 6 mm | Nip width: 7 mm |
|---|---|---|---|
| Comparative Example 1 | Poor | Poor | Poor |
| Comparative Example 2 | Poor | Poor | Good |
| Embodiment | Good | Good | Good |

In the above description, the extending portion 140*b* of the heat conducting member 140 is disposed upstream of the heater 113 in the printing-material conveying direction, but this is given for mere illustration. The temperature of the fixing film 112 is lower on the upstream than on the downstream of the heater 113 in the printing-material conveying direction. For that reason, disposing the extending portion 140*b* upstream enables efficient heat transfer from the extending portion 140*b* to the fixing film 112.

Figure 5A:
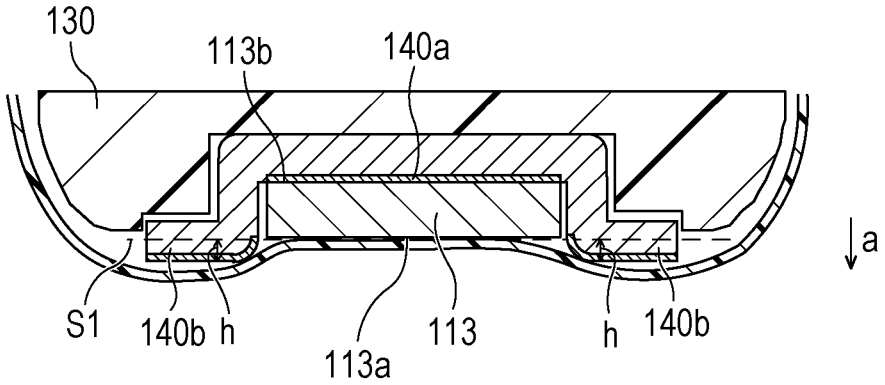
FIG. 5A is a schematic cross-sectional view of a heat transfer member and a heater according to Modification 2 of the first embodiment illustrating the positional relationship therebetween.
Figure 5B:
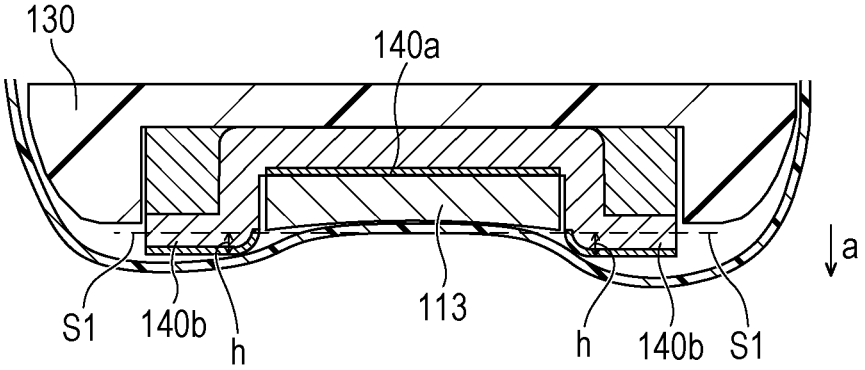
FIG. 5B is a schematic cross-sectional view of a heat transfer member and a heater according to Modification 2 of the first embodiment illustrating the positional relationship therebetween.

FIGS. 5A and 5B are cross-sectional views of modifications of the present embodiment illustrating the configuration thereof. In the modifications, the extending portion 140*b* is disposed on each of the upstream side and the downstream side in the printing-material conveying direction. FIG. 5A illustrates a configuration using a two-step Z-shaped bent heat conducting member 140*c*. FIG. 5B illustrates a configuration using a U-shaped bent heat conducting member 140*c*. A feature of the modifications is that the efficiency of heat transfer from the heater 113 to the fixing film 112 can be further increased from the first embodiment.

In the modifications, the extending portions 140*c* on the upstream side and the downstream side in the printing-material conveying direction may have different shapes. Any shape may be selected, for example, the extending portion 140*b* on the upstream side is Z-shaped, and the extending portion 140*b* in the downstream side is L-shaped.

As described above, in the present embodiment, fixing unevenness can be prevented regardless of the rotation track of the fixing film 112 by protruding the extending portion 140*b* from the sliding surface of the heater 113 toward the pressure roller 110.

Second Embodiment

The configuration of the present embodiment is similar to the configuration of the first embodiment except that the shape of the heater holder 130 differs. Therefore, a description of the configuration other than the configuration of the heater holder 130 will be omitted.

In the present embodiment, the protrusion amount h of an extending portion 140*b* is set at 100 μm, as in the first embodiment. The present embodiment includes a restricting portion 150 for restricting the rotation track of the fixing film 112 on the upstream side of the extending portion 140*b* in the rotational direction of the fixing film 112 (the printing-material conveying direction). The restricting portion 150 is disposed at the heater holder 130 and extends in a direction from the second surface 113*b* of the heater 113 toward the first surface 113*a* on the outside of the upstream end of the extending portion 140*b* of the heat conducting member 140 in the rotational direction of the fixing film 112. The restricting portion 150 protrudes toward the fixing film 112 further than the extending portion 140*b*.

The definition of the protrusion amount h' of the restricting portion 150 will be described with reference to FIG. 6C. As in definition of the protrusion amount h of the extending portion 140*b*, let S1 be a line extending from a surface (a first surface) of the heater 113 in contact with the fixing film 112 of the heater 113 to the upstream side in the printing-material conveying direction. Let a be a direction perpendicular to the first surface of the heater 113. Let S2 be a line passing through a maximum protruding portion with the protrusion amount h of the extending portion 140*b* and parallel to S1. The protrusion amount h is 0 when the maximum protruding portion is on the line S1, and positive when the maximum protruding portion protrudes in the direction of arrow a. The maximum value thereof is defined as the protrusion amount h' of the restricting portion 150. The protrusion amount h' of the restricting portion 150 in the present embodiment is set at 200 μm to allow stably restricting the rotation track of the fixing film 112.

The advantageous effect of the restricting portion 150 of the heater holder 130 will be evaluated. In the present embodiment, the evaluation was performed in a low-temperature environment to perform the evaluation under further sever conditions. In a low-temperature environment, the amount of heat transferred from the heater 113 and the extending portion 140*b* to the fixing film 112 is larger than in an ordinary-temperature environment. Therefore, fluctuations in the contact area between the extending portion 140*b* and the fixing film 112 cause fixing unevenness. The configuration of the present embodiment has the effect of stabilizing the state of contact between the fixing film 112 and the heat conducting member 140.

A method of evaluation in the present embodiment is similar to that of the first embodiment except the evaluation environment. The evaluation was conducted in a low-temperature low-humidity environment of a room temperature of 15° C. and a relative humidity of 10%. The heater 113 is left for about one hour without being supplied with electric power, and a sheet of paper with a stripe image (2-dot/3-space) was passed to check fixing unevenness. The paper used was XEROX Vitality (75 g/m$^2$, LTR).

Figure 6A:
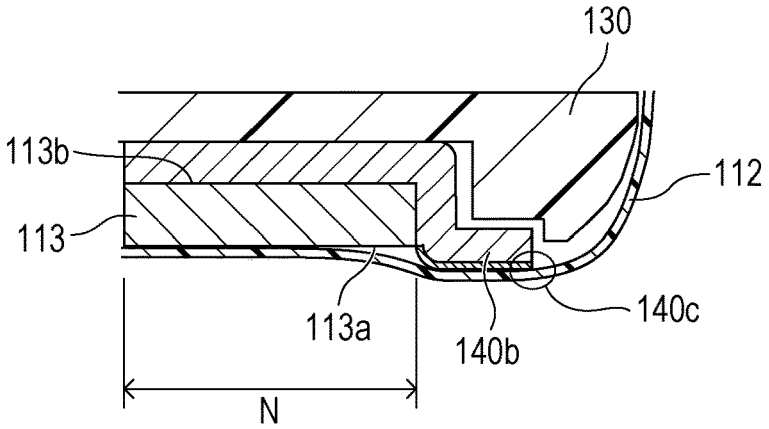
FIG. 6A is a schematic cross-sectional view of the rotation track of a fixing film and a heat transfer member according to the first embodiment illustrating the positional relationship therebetween.
Figure 6B:
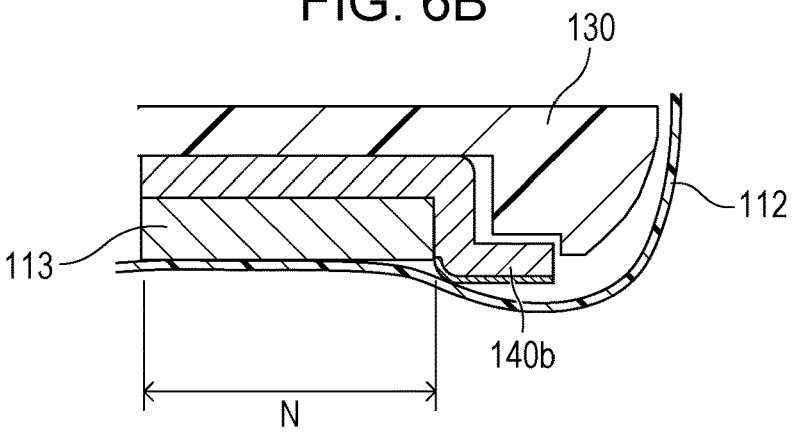
FIG. 6B is a schematic cross-sectional view of the rotation track of a fixing film and a heat transfer member according to the first embodiment illustrating the positional relationship therebetween.
Figure 6C:
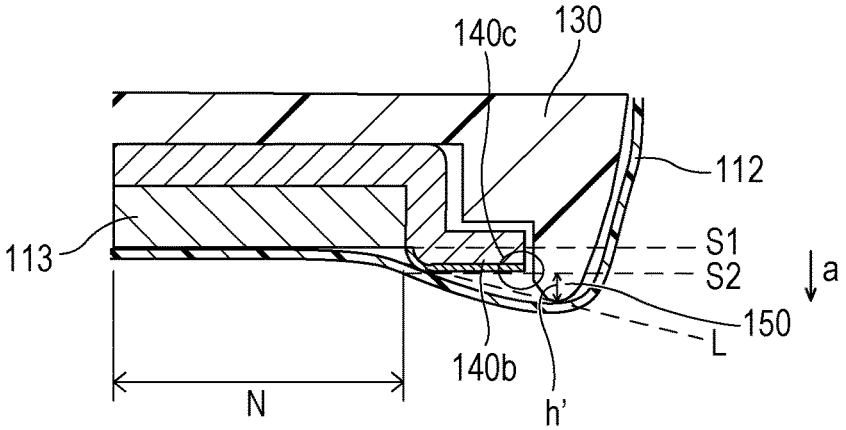
FIG. 6C is a schematic cross-sectional view of the rotation track of a fixing film and a heat transfer member according to a second embodiment of the present disclosure illustrating the positional relationship therebetween.

FIGS. 6A and 6B illustrate the configuration of the first embodiment. These are schematic enlarged diagrams mainly illustrating the extending portion 140*b* and the rotation track of the fixing film 112 when the protrusion amount h of the extending portion 140*b* from the first surface 113*a* of the heater 113 is set at 100 μm or more, and the restricting portion 150 is not provided. With this configuration, even if the rotation track of the fixing film 112 changes, the inner surface of the fixing film 112 can keep contact with part of the extending portion 140*b*, so that fixing unevenness can be reduced or eliminated. However, in the case where the rotation track of the fixing film 112 has a shape along the extending portion 140*b*, as illustrated in FIG. 6A, the area of contact is large, and in the case where the rotation track of the fixing film 112 bends toward the pressure roller 110, as illustrated in FIG. 6B, the area of contact is small. In particular, at the start of the fixing apparatus 100 in a low-temperature environment, the amount of heat transferred from the heater 113 to the fixing film 112 is large, so that fixing unevenness tends to occur under the influence of a change in contact area.

With the configuration of the present embodiment, changes in the rotation track of the fixing film 112 can be reduced or eliminated by bending the rotation track of the fixing film 112 in advance using the restricting portion 150, so that the fluctuation in the contact area between the fixing film 112 and the extending portion 140*b* can be prevented.

Another advantage of providing the restricting portion 150 is that an edge 140*c* of the extending portion 140*b* on the upstream side in the printing-material conveying direction is prevented from coming into contact with the fixing film 112. In the case where the rotation track of the fixing film 112 follows the extending portion 140*b*, as illustrated in FIG. 6A, the edge 140*c* of the extending portion 140*b* slides on the inner surface of the fixing film 112. In the case where the heat conducting member 140 is made of a metal plate with high heat conductivity, such as aluminum, the edge 140*c* may be sharp. When the edge 140*c* of the heat conducting member 140 slides on the inner surface of the fixing film 112, the fixing film 112 is prone to be scraped. For that reason, the edge 140*c* of the extending portion 140*b* may be configured not to come into contact with the inner surface of the fixing film 112. As illustrated in FIG. 6C, the edge 140*c* of the extending portion 140*b* is disposed on the opposite side of a line L connecting the portion of the extending portion 140*b* sliding on the inner surface of the fixing film 112 and the protrusion of the restricting portion 150 from the pressure roller 110.

Figure 7:
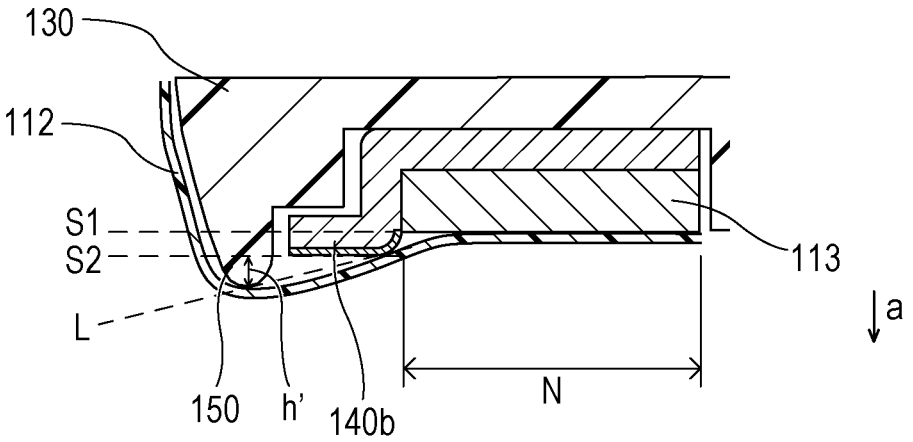
FIG. 7 is a schematic cross-sectional view of a restricting member of a heater holder, a heat transfer member, and a heater according to Modification 1 of the second embodiment illustrating the positional relationship thereamong.
Figure 8:
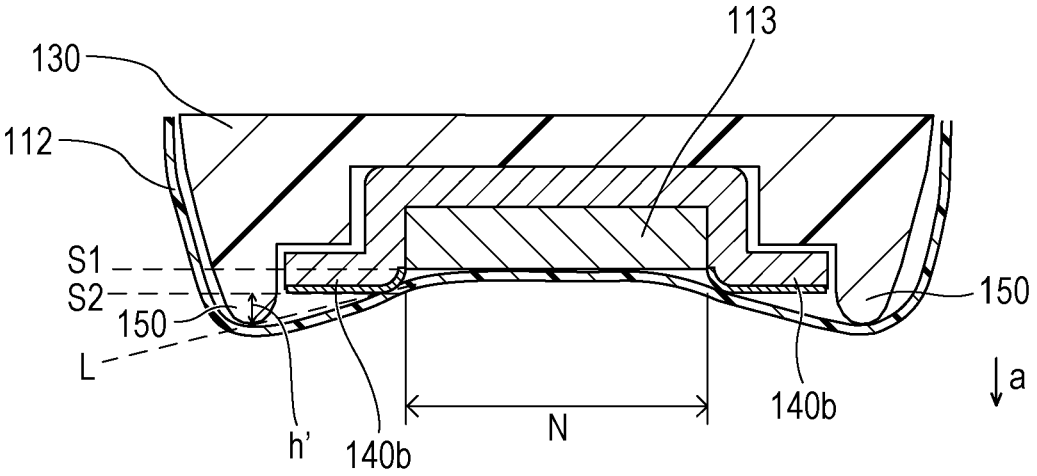
FIG. 8 is a schematic cross-sectional view of a restricting member of a heater holder, a heat transfer member, and a heater according to Modification 2 of the second embodiment illustrating the positional relationship thereamong.

Although the extending portion 140*b* of the heat conducting member 140 is disposed on the upstream side of the heater 113 in the printing-material conveying direction, as in the first embodiment, this is given for mere illustration. In other words, the present embodiment can also be applied to a case in which the extending portion 140*b* is disposed downstream in the rotational direction of the fixing film 112 (printing-material conveying direction) from the heater 113, as in Modification 1 of the present embodiment, illustrated in FIG. 7. The present embodiment can also be applied to a configuration in which the extending portion 140*b* is disposed upstream and downstream in the printing-material conveying direction, as in Modification 2 of the present embodiment, illustrated in FIG. 8.

Third Embodiment

A third embodiment of the present disclosure will be described hereinbelow. The configuration of the third embodiment is similar to the configuration of the first embodiment except that the shapes of the extending portion 140*b* of the heat conducting member 140 and the heater holder 130 differ. Therefore, a description of the details of the configuration of the fixing apparatus 100 will be omitted.

Figure 9A:
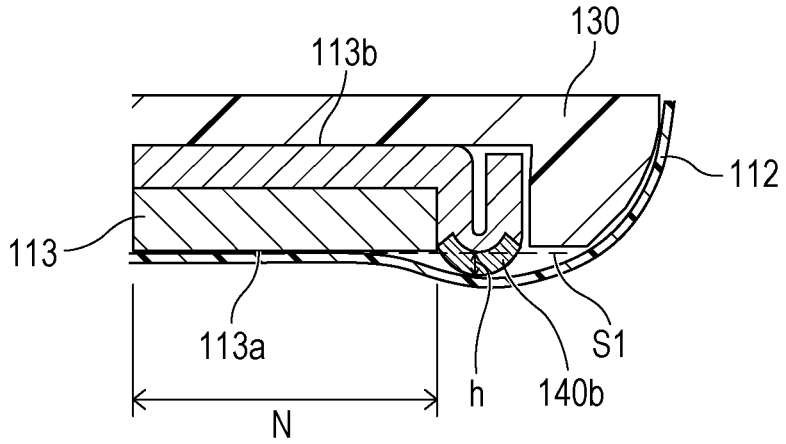
FIG. 9A is a schematic cross-sectional view of the rotation track of a fixing film, a heat transfer member, and a heater according to a third embodiment of the present disclosure illustrating the positional relationship thereamong.
Figure 9B:
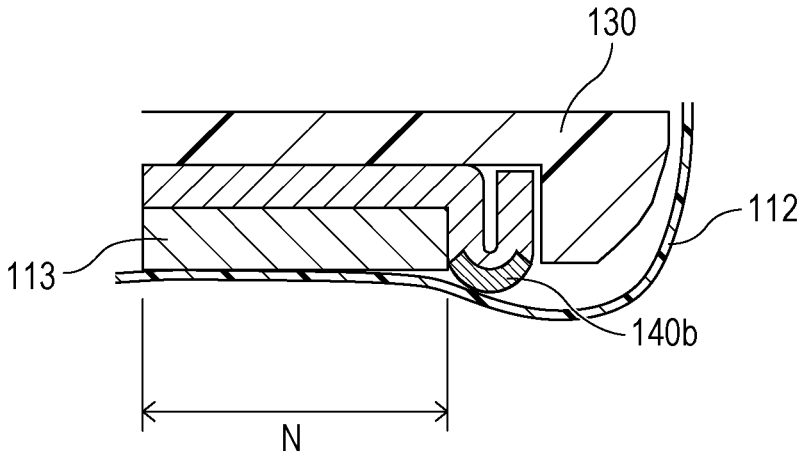
FIG. 9B is a schematic cross-sectional view of the rotation track of a fixing film, a heat transfer member, and a heater according to the third embodiment illustrating the positional relationship thereamong.

A restricting portion 150 of the present embodiment will be described with reference to FIGS. 9A and 9B. In the present embodiment, the protrusion amount h of the extending portion 140*b* is set at 100 μm, as in the first embodiment. Furthermore, an end of the extending portion 140*b* on the upstream side in the printing-material conveying direction is folded back in a direction away from the inner surface of the fixing film 112 (the pressure roller 110) so that the portion in contact with the inner surface of the fixing film 112 is curved. This reduces or eliminates changes in the contact area between the extending portion 140*b* and the fixing film 112 between a case in which the rotation track of the fixing film 112 follows the extending portion 140*b*, as in FIG. 9A, and a case in which the rotation track of the fixing film 112 bends greatly toward the pressure roller 110 as in FIG. 9B. This allows the heat from the heater 113 to be stably supplied to the fixing film 112 through the heat conducting member 140 even in a low-temperature environment, reducing or eliminating fixing unevenness.

Figure 10:
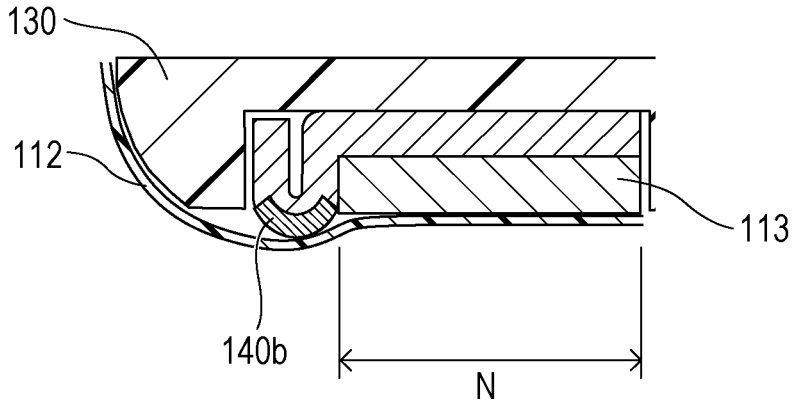
FIG. 10 is a schematic cross-sectional view of a heat transfer member and a heater according to Modification 1 of the third embodiment.
Figure 11:
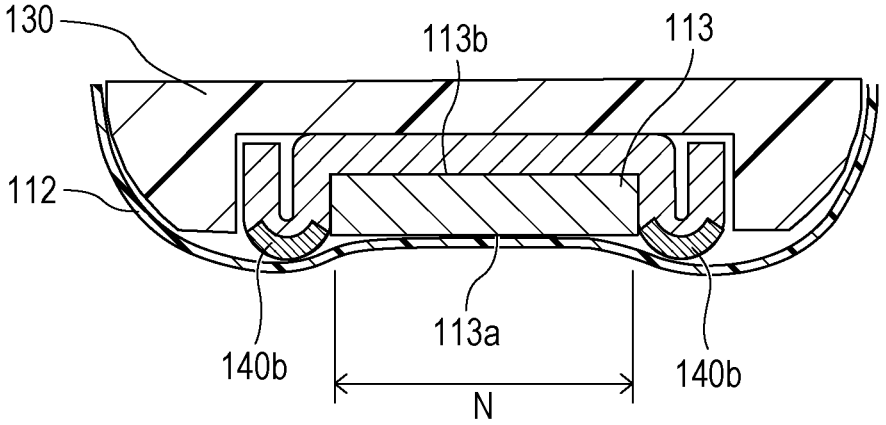
FIG. 11 is a schematic cross-sectional view of a heat transfer member and a heater according to Modification 2 of the third embodiment.

Although the extending portion 140*b* of the heat conducting member 140 is disposed on the upstream side of the heater 113 in the printing-material conveying direction, as in the first embodiment, this is given for mere illustration. The extending portion 140*b* may be disposed downstream from the heater 113 in the printing-material conveying direction), as in Modification 1 of the present embodiment, illustrated in FIG. 10. The extending portion 140*b* may also be disposed upstream and downstream in the printing-material conveying direction, as in Modification 2 of the present embodiment, illustrated in FIG. 11.

Fourth Embodiment

Figure 13A:
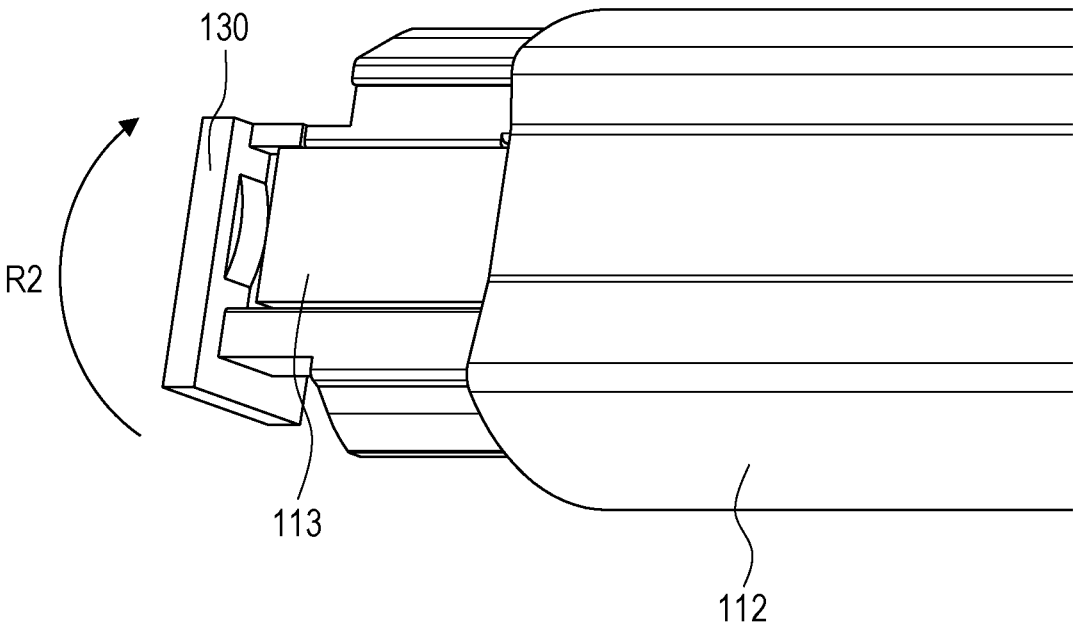
FIG. 13A is an enlarged diagram of a longitudinal end of the fixing film unit according to the fourth embodiment.
Figure 13B:
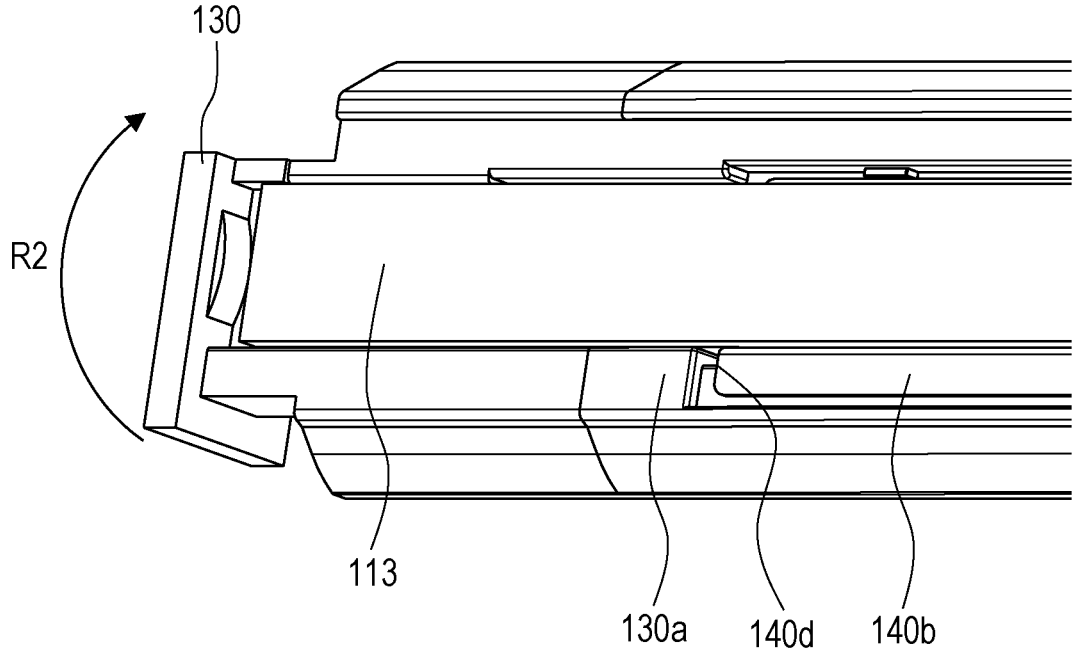
FIG. 13B is an enlarged diagram of a longitudinal end of the fixing film unit according to the fourth embodiment in which the fixing film is not illustrated.
Figure 14:
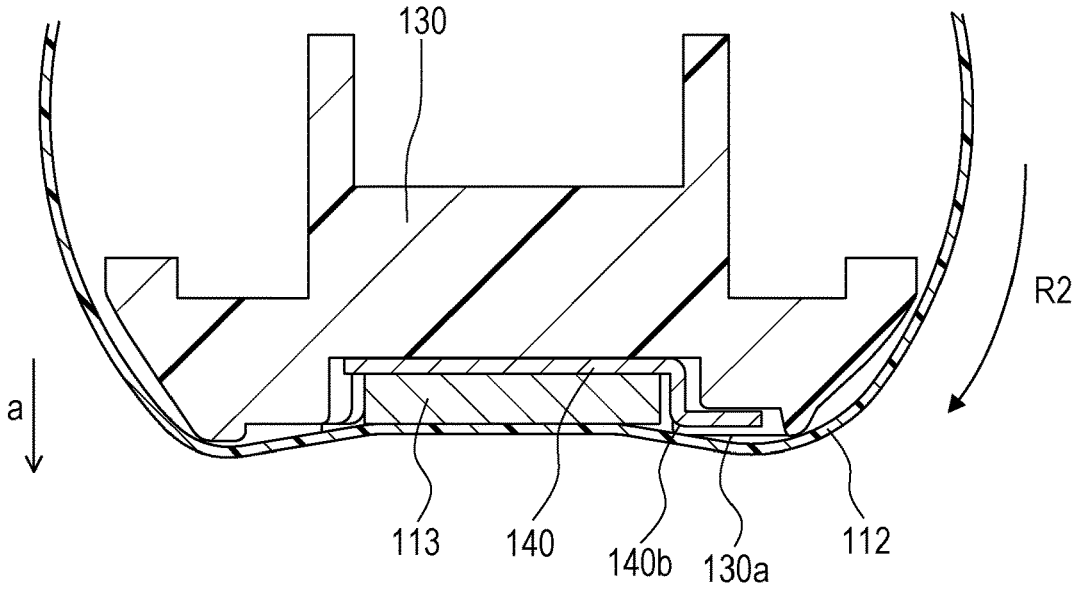
FIG. 14 is a cross-sectional view of a longitudinal end of the fixing film unit according to the fourth embodiment.

In the present embodiment, the configuration of the longitudinal end of the extending portion 140*b* of the heat conducting member 140 and the heater holder 130 will be described with reference to FIGS. 12 to 14. Since the configuration of the present embodiment is similar to the configuration of the first embodiment except the longitudinal end of the heat conducting member 140 and the longitudinal end of the heater holder 130, descriptions thereof will be omitted.

Figure 12:
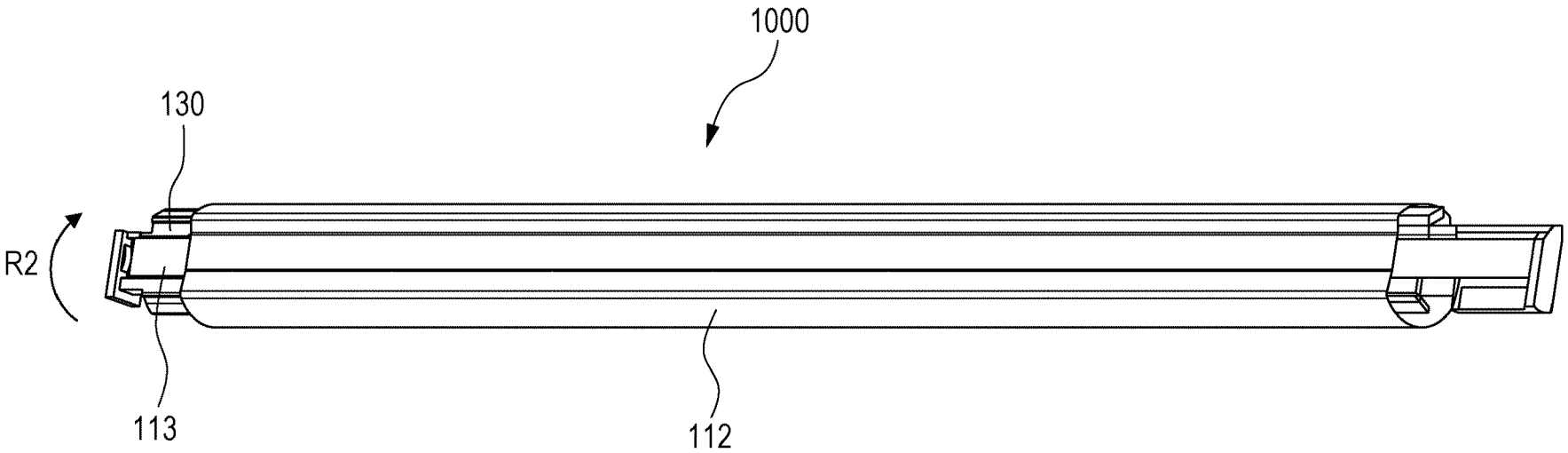
FIG. 12 is a perspective view of a fixing film unit according to a fourth embodiment of the present disclosure.

FIG. 12 is a perspective view of a film unit 1000 viewed from the heater 113. FIGS. 13A and 13B are enlarged diagrams of a longitudinal end of the film unit 1000. FIG. 13A is a diagram in which the fixing film 112 is illustrated. FIG. 13B is a diagram in which the fixing film 112 is not illustrated. As illustrated in FIG. 13A, a longitudinal end face 140*d* of the extending portion 140*b* of the heat conducting member 140 is disposed inside a longitudinal end of the fixing film 112 in the longitudinal direction of the fixing film 112.

In the case where the heat conducting member 140 is made of a metal plate, such as an aluminum alloy, the heat conducting member 140 is often manufactured by press working. Therefore, when the edge of the longitudinal end face 140*d* of the heat conducting member 140 slides while being in close-contact with the fixing film 112, the fixing film 112 is prone to be scraped.

To solve the above problem, the present embodiment is characterized in that the heater holder 130 includes a film contact surface 130*a* outside the longitudinal end face 140*d* of the heat conducting member 140 in the longitudinal direction of the heater 113, as illustrated in FIG. 13B. The film contact surface 130*a* will be described with reference to FIG. 14. FIG. 14 is a cross-sectional view of the longitudinal end of the film unit 1000 perpendicular to the longitudinal direction of the heater 113. As illustrated in FIG. 14, the film contact surface 130*a* protrudes more in the direction of arrow a than the extending portion 140*b*. The arrow a is directed from the second surface 113*b* of the heater 113 toward the first surface 113*a*. With this configuration, the fixing film 112 is supported in contact with the film contact surface 130*a*. This prevents the fixing film 112 from coming into strong-contact with the edge of the longitudinal end face 140*d* of the heat conducting member 140. Furthermore, since the heater holder 130 can be made of resin, the ridge of a surface of the film contact surface 130*a* facing the longitudinal end face 140*d* can be formed into a curve, preventing the wearing of the fixing film 112. By setting a surface of the heat conducting member 140 adjacent to the extending portion 140*b* to the rolled over side in press working, the ridge of the longitudinal end face 140*d* adjacent to the fixing film 112 is rolled over, so that the wearing of the fixing film 112 can be further prevented.

Although one longitudinal end of the fixing film unit 1000 in FIG. 12 has been described, the other longitudinal end has the same configuration. The film contact surface 130*a* may be flush with the extending portion 140*b*.

Figure 4A:
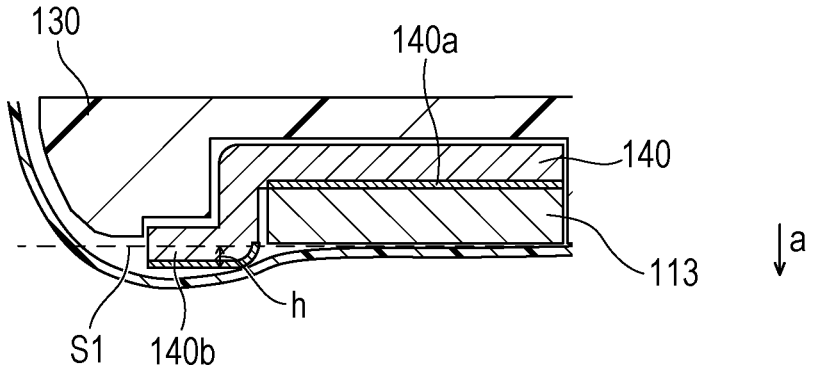
FIG. 4A is a schematic cross-sectional view of a heat transfer member and a heater according to Modification 1 of the first embodiment illustrating the positional relationship therebetween.
Figure 4B:
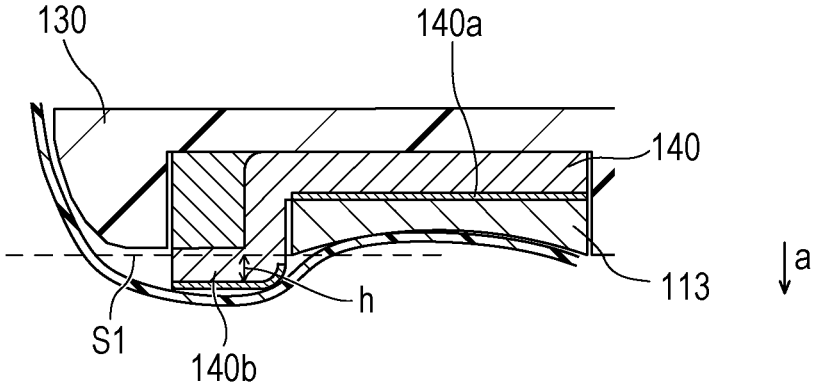
FIG. 4B is a schematic cross-sectional view of a heat transfer member and a heater according to Modification 1 of the first embodiment illustrating the positional relationship therebetween.

In the present embodiment, the extending portion 140*b* of the heat conducting member 140 is disposed upstream from the heater 113 in the printing-material conveying direction. This is because the temperature of the fixing film 112 is lower on the upstream side of the heater 113 in the printing-material conveying direction than on the downstream side, so that disposing the extending portion 140*b* on the upstream side enables efficient heat transfer from the extending portion 140*b* to the fixing film 112. However, the extending portion 140*b* may be disposed downstream of the heater 113 in the printing-material conveying direction, like the configuration illustrated in FIGS. 4A and 4B.

Alternatively, by combining the configurations illustrated in FIGS. 3A and 3B and FIGS. 4A and 4B in the first embodiment to dispose the extending portion 140*b* of the heat conducting member 140 on both the upstream side and the downstream side of the heater 113 in the printing-material conveying direction, as illustrated in FIGS. 5A and 5B, heat transfer to the fixing film 112 can be further increased.

Figure 15:
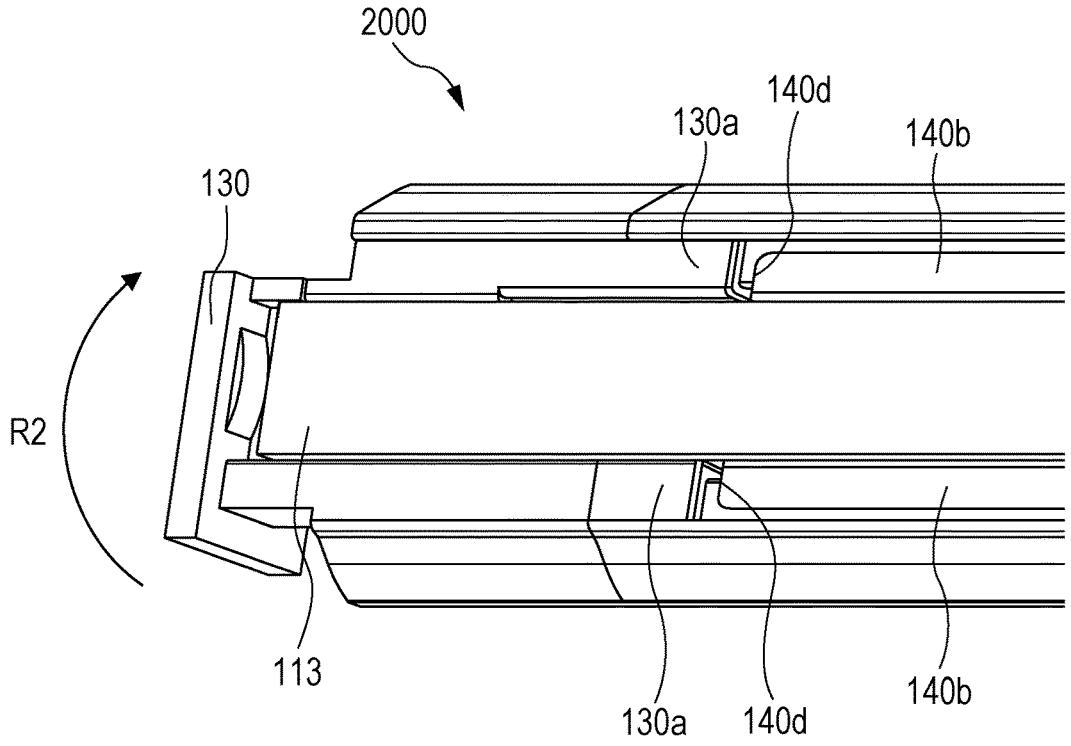
FIG. 15 is an enlarged diagram of a longitudinal end of the fixing film unit according to a modification of the fourth embodiment.
Figure 16:
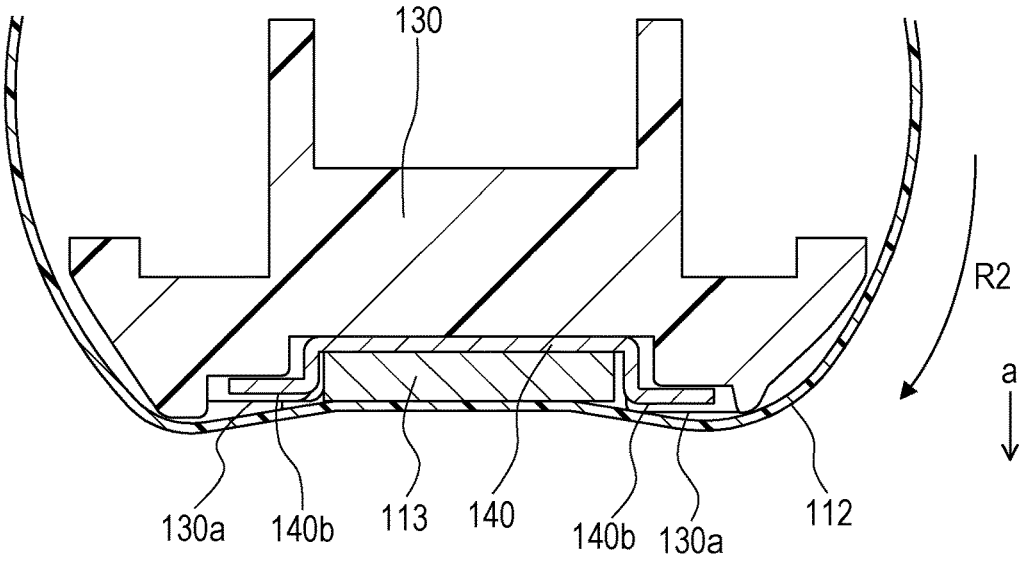
FIG. 16 is a cross-sectional view of the longitudinal end of the fixing film unit according to the modification of the fourth embodiment.

FIGS. 15 and 16 are respectively a perspective view (the fixing film 113 is not illustrated) of a longitudinal end of a film unit 2000 of a modification of the fourth embodiment and a cross-sectional view thereof perpendicular to the longitudinal direction of the heater 113. In this modification, the film contact surface 130*a* of the heater holder 130 and the extending portion 140*b* of the heat conducting member 140 are disposed both the upstream side and the downstream side of the heater 113 in the printing-material conveying direction. As illustrated in FIG. 16, the film contact surface 130*a* of the heater holder 130 protrudes more in the direction of arrow a than the extending portion 140*b* of the heat conducting member 140. The direction of arrow a is a direction nearer to the inner surface of the fixing film 112 which the extending portion 130*a* faces. The film contact surface 130*a* may be flush with the extending portion 140*b*.

In the present embodiment and the modification of the present embodiment, one end of the film unit in the longitudinal direction has been described. The same configuration applies to the other end.

The same advantageous effects can be obtained by using the configurations of the present embodiment and the modification of the present embodiment for the heat conducting members of the second and third embodiments.

Fifth Embodiment

Unlike the first embodiment, the present embodiment includes a temperature sensor (thermistor) 115 for detecting the temperature of the heater 113 or the fixing film 112 and is configured to control electric power to be supplied to the heating resistor of the heater 113 in response to a signal from the thermistor 115. Differences from the configuration of the first embodiment will be described with reference to FIGS. 17 to 20 of the present embodiment, and descriptions of the same configurations as those of the first embodiment will be omitted.

(Fixing Apparatus)

Figure 17:
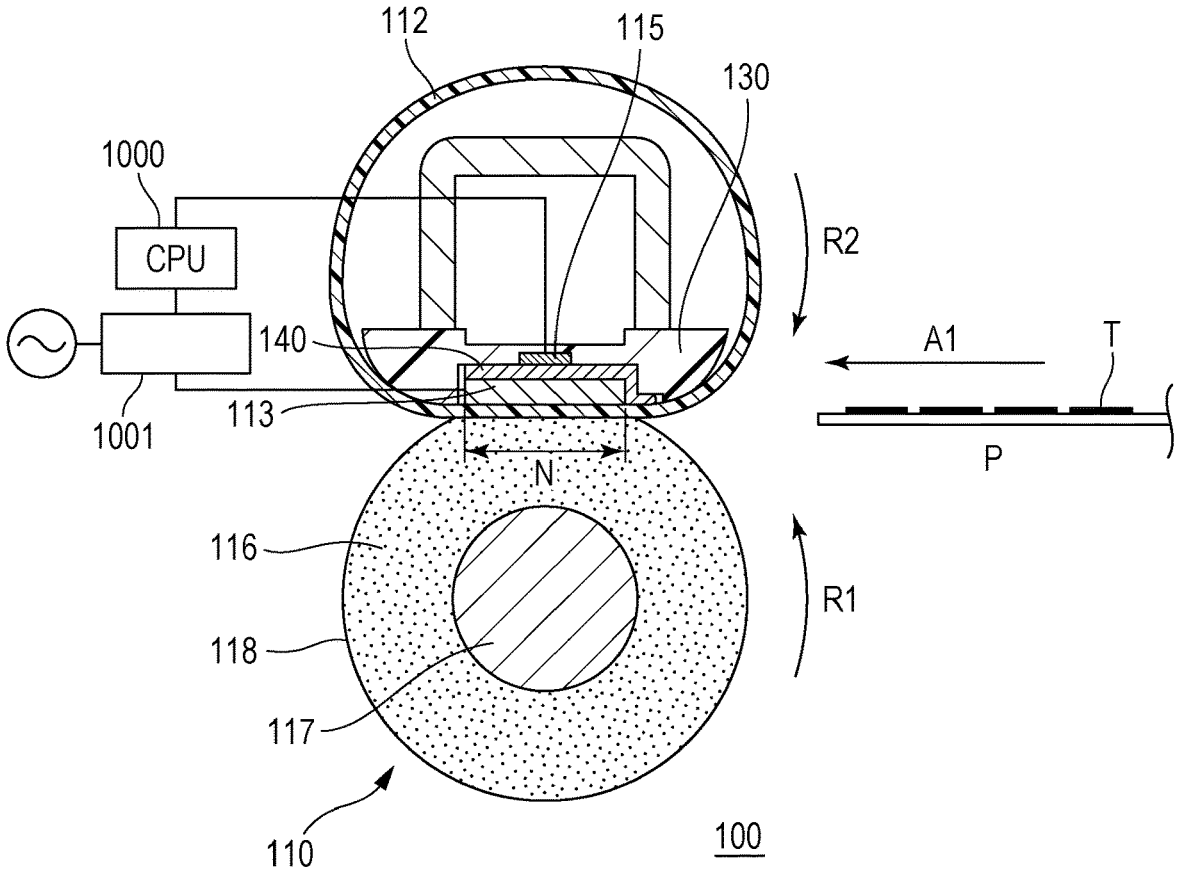
FIG. 17 is a schematic cross-sectional view of a fixing apparatus according to a fifth embodiment of the present disclosure.

A fixing apparatus 100 of the present embodiment will be described hereinbelow. FIG. 17 is a cross-sectional view of the fixing apparatus 100 of the present embodiment.

Figure 18:
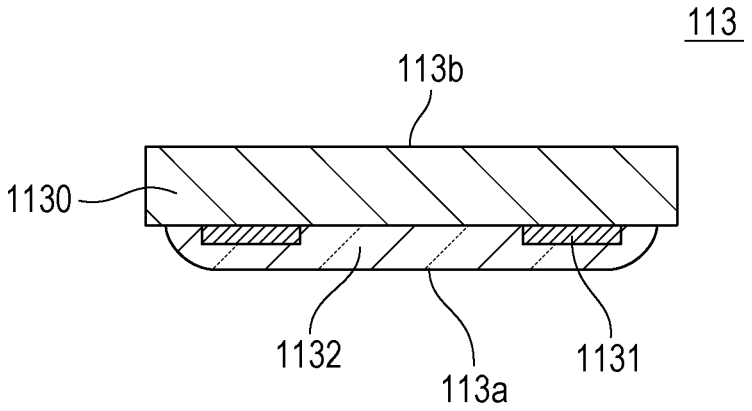
FIG. 18 is a schematic cross-sectional view of a heater according to the fifth embodiment.

FIG. 18 is a schematic cross-sectional view of a heater 113 perpendicular to the longitudinal direction thereof. The heater 113 is an elongate plate-like member having a first surface 113*a* in contact with the inner surface of a fixing film 112 and a second surface 113*b* opposite to the first surface 113*a*. The heater 113 includes a substrate 1130, a heating resistor 1131 disposed on the substrate 1130, and a protective layer 1132 disposed so as to cover the heating resistor 1131. The substrate 1130 is made of ceramic, such as alumina or aluminum nitride. The substrate 1130 of the present embodiment is made of alumina and has a width of 6 mm in the printing-material conveying direction and a thickness of 1 mm. The heating resistor 1131 is formed by coating the surface of the substrate 1130 with Ag/Pd (silver-palladium) having a thickness of 10 μm by screen printing. The protective layer 1132 is made of glass having a thickness of 50 μm.

Figure 19:
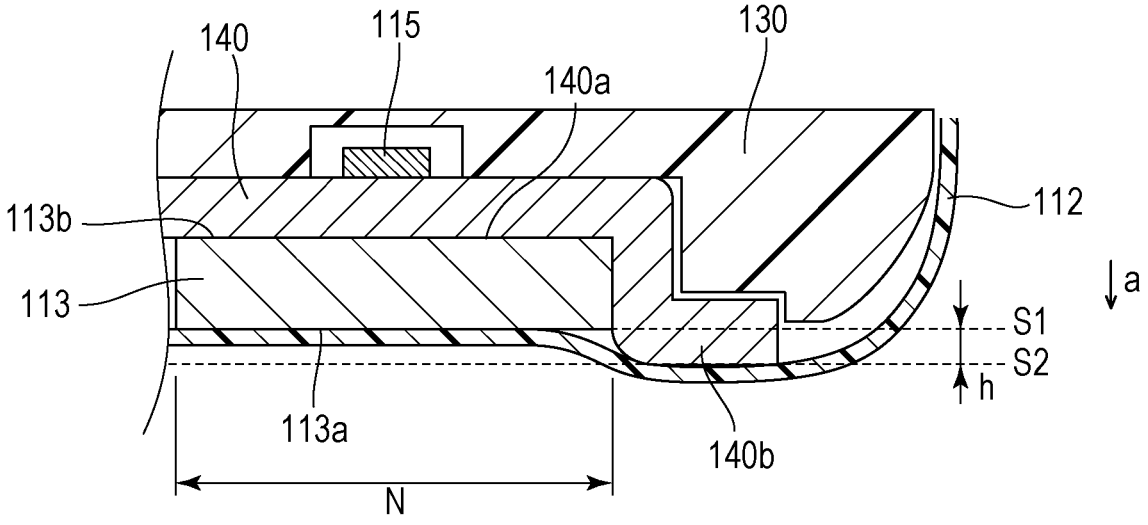
FIG. 19 is an enlarged cross-sectional view of a fixing film, a heater, a heat conducting member, and so on according to the fifth embodiment illustrating the positional relationship thereamong.

FIG. 19 is a schematic cross-sectional view of the fixing film 112, the heater 113, the heat conducting member 140, and so on perpendicular to the length of the heater 113, illustrating the positional relationship therebetween in enlarged view. The heat conducting member 140 is disposed between the heater 113 and the heater holder 130 so as to be in contact with the second surface 113*b* of the heater 113. A portion of the heat conducting member 140 including a surface in contact with the second surface 113*b* of the heater 113 is referred to as a heater contact portion 140*a*. Although the heater contact portion 140*a* may be in contact with any surface of the heater 113, the heater contact portion 140*a* of the present embodiment is in contact with the second surface 113*b* of the heater 113. This allows the heat conducting member 140 to be in contact with a large area of the heater 113, offering good adhesion due to the pressure force from the pressure roller 110. The heat conducting member 140 includes an extending portion 140*b* outside an end of the heater 113 upstream in the rotational direction of the fixing film 112 (a printing-material conveying direction). The extending portion 140*b* protrudes in the direction of arrow a (toward the fixing film 112) more than the first surface 113*a* of the heater 113, as in the first embodiment. The direction of array a is directed from the second surface 113*b* toward the first surface 113*a*. The extending portion 140*b* further extends from a portion extending in a direction from the second surface 113*b* of the heater 113 to the first surface 113*a* in a direction away from the heater 113 in the rotational direction of the fixing film 112, so that the area of contact with the inner surface of the fixing film 112 is large.

Next, the thermistor 115 serving as a temperature sensor, illustrated in FIGS. 17 and 19 will be described. The thermistor 115 is disposed in contact with a surface of the heat conducting member 140 opposite to the surface of the heater contact portion 14*a* of the heat conducting member 140 in contact with the second surface 113*b* of the heater 113. A control unit 1000 illustrated in FIG. 17 controls electric power to be supplied to the heater 113*a* by controlling a triac 1001 so that the temperature detected by the thermistor 115 reaches a target fixing temperature.

In order to detect a change in the temperature of the fixing film 112 via the heat conducting member 140 with the thermistor 115, the extending portion 140*b* of the heat conducting member 140 may be stably in contact with the fixing film 112. However, since the fixing film 112 is a flexible member, the position of the fixing film 112 in the thickness direction can fluctuate during rotation. At that time, the contact area between the extending portion 140*b* of the heat conducting member 140 and the fixing film 112 fluctuates.

In the present embodiment, a surface of the extending portion 140*b* in contact with the fixing film 112 protrudes in the direction of arrow a by the protrusion amount h with respect to the first surface 113*a* of the heater 113 so that fluctuations in the contact area between the extending portion 140*b* of the heat conducting member 140 and the fixing film 112 are reduced. This enables the change in the temperature of the fixing film 112 to be detected by the thermistor 115 with high responsiveness.

Figure 20:
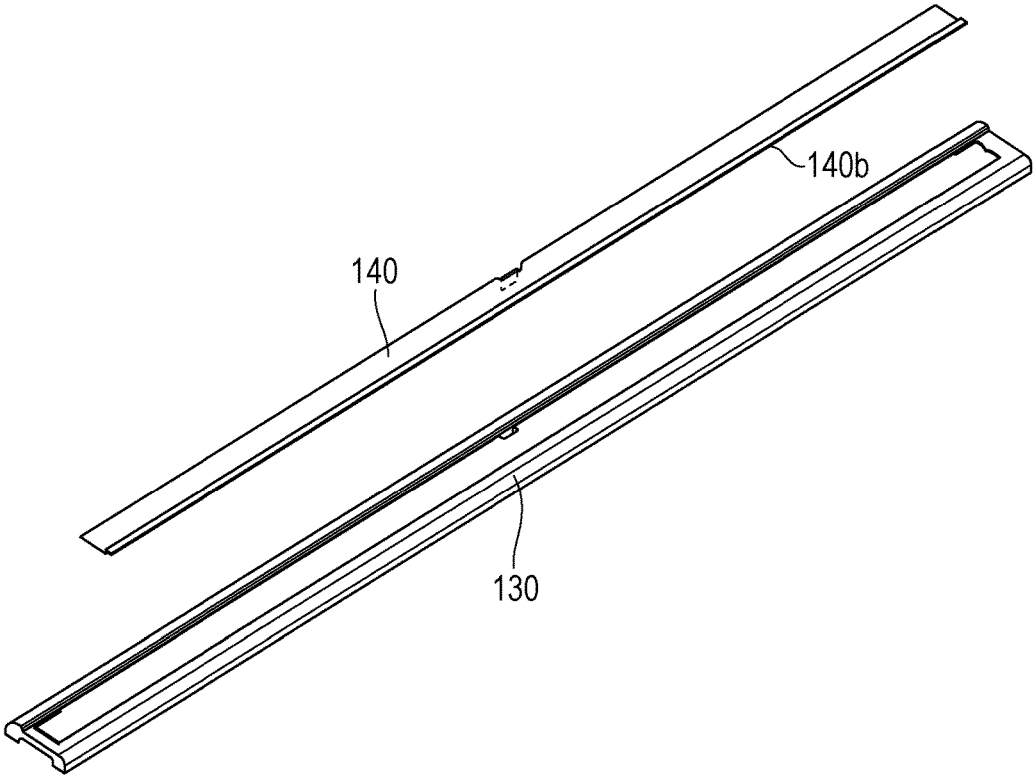
FIG. 20 is a perspective view of the heater and the heater holder according to the fifth embodiment.

FIG. 20 is a perspective view of the heat conducting member 140 and the heater holder 130 according to the present embodiment. The extending portion 140*b* may be disposed in an area of the heat conducting member 140 overlapping with the detection area of the thermistor 115 in the longitudinal direction of the heater 113. The extending portion 140*b* of the present embodiment is disposed in the longitudinal direction of the heat conducting member 140. The heat conducting member 140 is in contact with the heater 113 over a running area and a non-running area of small-size printing materials and has an advantage in suppressing an increase in the temperature of the paper non-running area.

When the printing material reaches the nip N, it derives heat from the fixing film 112 in the vicinity of the nip N. The thermistor 115 detects the change in the temperature of the fixing film 112 from which heat is drawn by the printing material. The control unit 1000 controls electric power to be supplied to the heating resistor 1131 of the heater 113 so that the detected temperature reaches a target temperature. When a printing material having a high coverage rate pattern, such as a graphic image, or a printing material with high moisture content is subjected to a fixing process, the printing material draws more heat from the fixing film 112 in the vicinity of the nip N, so that the temperature of the fixing film 112 drops greatly. If the time until the decrease in the temperature of the fixing film 112 is detected by the thermistor 115 is long, the timing to increase the amount of heat generated from the heater 113 is also delayed, so that the temperature of the fixing film 112 decreases continuously. When the temperature of the fixing film 112 is thus lowered, a fixing defect can occur. To cope with it, there is a method for constantly setting the target temperature of the heater 113 high in advance so as to satisfy the fixing performance even if the temperature of the fixing film 112 drops greatly when a pattern with high coverage rate or a printing material with high moisture content is subjected to fixing processing. However, when the target temperature of the temperature detecting member 115 is always set high, excessive electric power is supplied to the heater 113 even for a printing material on which an image with a low-coverage rate, which needs less heat, is formed, resulting in a decrease in power saving function.

To address this problem, the present embodiment includes not only a heat transfer path from the fixing film 112 to the thermistor 115 via both of the two components, the heater 113 and the heat conducting member 140, but also a path via only the heat conducting member 140. This produces the effect that a change in the temperature of the fixing film 112 can be detected via the heat conducting member 140 by the thermistor 115 even if the thermistor 115 is not in direct-contact with the fixing film 112.

The following is a verification whether a change in the temperature of the fixing film 112 can be detected with high responsiveness by the thermistor 115 in the case where the coverage rate of the printing material is varied and the case where printing materials having different moisture contents are used in the present embodiment. Fixing temperatures of the temperature sensor 115 necessary for fixing processing under various conditions were calculated. The fact that it is necessary to increase the fixing temperature means that the timing when the amount of heat generated from the heater 113 is delayed from the timing when the temperature of the fixing film 112 decreases. In other word, the responsiveness of detecting the decrease in the temperature of the fixing film 112 with the temperature sensor 115 is low.

The present embodiment is compared with Comparative Example 3 in which the protrusion amount h is −100 μm and Comparative Example 4 in which the protrusion amount h is 0 μm. Furthermore, evaluation was conducted under the following three conditions to confirm that the high responsiveness of the thermistor 115 for the fixing film 112 does not depend on the nip width between the extending portion 140*b* of the heat conducting member 140 and the fixing film 112, that is, the contact state. The first condition is that the pressing force at the nip N is low and the roller hardness is high, so that the width of the nip N is decreased (pressing force: 13 kgf, roller hardness: 52°, nip width: 5 mm). The second is a condition under with the width of the nip N is increased (pressing force: 15 kgf, roller hardness: 48°, nip width: 7 mm). The third is a condition under which the width of the nip N is an intermediate value of the values under the above two conditions (pressing force: 14 kgf, roller hardness: 50°, nip width: 6 mm).

For print patterns for evaluation, a text pattern with a low toner coverage rate and a solid black pattern of printing toner on the entire surface were used. For the moisture content of the printing material, sample 1 which is a printing material immediately after being unpacked and sample 2 left for about one week after being unpacked. Since the experiment was conducted in a high-temperature high-humidity environment at a temperature of 30° C. and a humidity of 80%, the moisture content of sample 1 was about 4%, and the moisture content of sample 2 was about 8%.

In Comparative Example 3 in which the protrusion amount h is set at −100 μm, a fixing temperature necessary for fixing the solid black pattern needed to be 15° C. higher than a fixing temperature necessary for fixing the text pattern, with the other conditions unchanged. A fixing temperature necessary for fixing toner to sample 2 needed to be 10° C. higher than a fixing temperature necessary for fixing toner to sample 1, with the other condition unchanged. Furthermore, when the width of the nip N is decreased by 1 mm, there was the tendency for the necessary fixing temperature to be increased by 5° C., with the other conditions unchanged. Consequently, in Comparative Example 3, a fixing temperature for satisfying the fixing performance, that is, a target temperature in control, was 210° C. regardless of the print pattern, the moisture content of the printing material, and the width of the nip N.

In Comparative Example 4 in which the protrusion amount h is set at 0 μm, the same results as those of Comparative Example 3 were given when the width of the nip N is 5 mm and 6 mm. Also when the width of the nip N is 7 mm, that is, the width of the nip N is increased by 1 mm from 5 mm and 6 mm, a necessary fixing temperature could be decreased by 5° C., with the other conditions unchanged, as in Comparative Example 3. However, in the case where the width of the nip N is 7 mm, a fixing temperature necessary for fixing the solid black patter needed to be higher than a fixing temperature necessary for fixing the text pattern, with the other conditions unchanged. Furthermore, a fixing temperature necessary for fixing toner to sample 2 needed to be 5° C. higher than a fixing temperature necessary for fixing toner to sample 1, with the other condition unchanged. In other word, a necessary fixing temperature was lower than that in Comparative Example 3 only when the width of the nip N is 7 mm. This seems to be because the width of the heater 113 is smaller than the width of the nip N, the extending portion 140*b* of the heat conducting member 140 in the vicinity of the heater 113 and the inner surface of the fixing film 112 are brought into contact by the pressing force at the nip N, causing stable heat transfer. Thus, in Comparative Examples 3 and 4, a fixing temperature that satisfies the fixing performance, that is, a target temperature in control, was 210° C. regardless of the target print pattern, the moisture content of the printing material, and the width of the nip N.

In the present embodiment, a fixing temperature necessary for fixing a solid black pattern needed to be 5° C. higher than a fixing temperature necessary for fixing a text pattern, with the other conditions unchanged.

Furthermore, a fixing temperature necessary for fixing toner to sample 2 needed to be 5° C. higher than a fixing temperature necessary for fixing toner to sample 1, with the other conditions unchanged. With the configuration of the present embodiment, there is no change in the fixing temperature required at the three widths of the nip N in the experiment, and s fixing temperature that satisfies the fixing performance, that is, a target temperature in control, was 195° C., regardless of the width of the nip N, the print pattern, and the moisture content of the printing material. In other words, the configuration of the present embodiment allows the target temperature of the temperature sensor 115 in fixing processing to be lower than those in Comparative Examples 3 and 4. This may be due to the fact that the contact between the extending portion 140*b* and the fixing film 112 is kept even when the fixing film 112 rotates, so that the rotation track fluctuates. As a result, a decrease in the temperature of the fixing film 112 is detected by the thermistor 115 with high responsiveness, and the amount of heat generated from the heater 113 can be increased.

As described above, the present embodiment offers the advantage that a change in the temperature of the fixing film 112 can be detected with higher responsiveness than the first embodiment by the thermistor 115 via the heat conducting member 140.

In the present embodiment, the extending portion 140*b* of the heat conducting member 140 is disposed only on the upstream side of the heater 112 in the rotational direction of the fixing film 112. However, this is given for mere illustration. The extending portion 140*b* of the heat conducting member 140 may be disposed only downstream from the heater 112 in the rotational direction of the fixing film 112.

Figure 21:
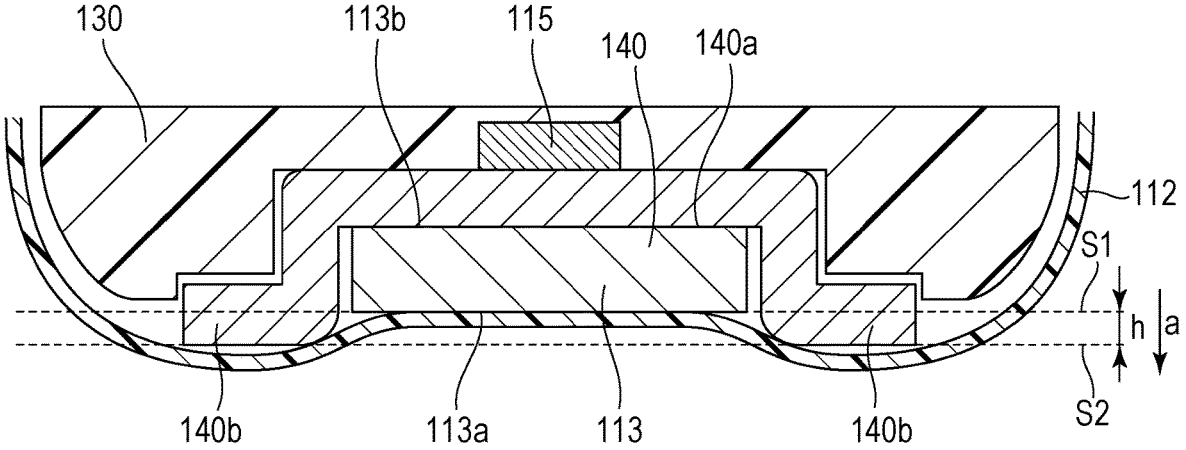
FIG. 21 is an enlarged cross-sectional view of a fixing film, a heater, a heat conducting member, and so on according to a modification of the fifth embodiment illustrating the positional relationship thereamong.

Next, a modification of the present embodiment will be described. FIG. 21 is an enlarged cross-sectional view of the fixing apparatus of the modification illustrating the positional relationship among the fixing film 112, the heater 113, the heat conducting member 140, and so on. The heat conducting member 140 includes the extending portion 140*b* not only upstream but also downstream from the heater 112 in the rotational direction of the fixing film 112. In this modification, the extending portion 140*b* on the downstream side has a protrusion amount h greater than 0. The protrusion amount h of the upstream and downstream extending portions 140*b* may differ.

In the configuration of the modification, the contact area between the heat conducting member 140 and the fixing film 112 is larger than the contact area in the fifth embodiment. Therefore, a change in the temperature of the fixing film 112 can be detected by the thermistor 115 via the heat conducting member 140 with higher responsiveness.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2017-128001, filed Jun. 29, 2017, and No. 2017-128002, filed Jun. 29, 2017, which are hereby incorporated by reference herein in their entirety.

The invention claimed is:

1. A fixing apparatus configured to heat a toner image to fix the toner image to a printing material, the apparatus comprising:

a tubular film;

an elongated plate-like heater including a first surface in contact with an inner surface of the film and a second surface opposite to the first surface;

a pressure roller in contact with an outer periphery of the film and configured to form a nip portion between the film and the pressure roller;

a heat conducting member that is in contact with the second surface of the heater; and a support member configured to support the heater and the heat conducting member, wherein the film is rotatable along the support member, wherein the film is held by the heater and the pressure roller therebetween, and an image on a printing material is heated at the nip portion formed between the film and the pressure roller and via the film, wherein the heat conducting member includes a first portion in contact with the second surface of the heater and a second portion provided outside of the heater on an upstream side in a rotational direction of the film, wherein the second portion includes a contact portion in contact with the inner surface of the film, and the contact portion protrudes toward the pressure roller farther than the first surface of the heater as viewed in a longitudinal direction of the heater, and wherein the support member includes a restricting portion provided outside of the second portion on the upstream side, and the restricting portion protrudes more than the second portion toward the pressure roller.

2. A fixing apparatus configured to heat a toner image to fix the toner image to a printing material, the apparatus comprising:

a tubular film;

an elongated plate-like heater including a first surface in contact with an inner surface of the film and a second surface opposite to the first surface;

a pressure roller in contact with an outer periphery of the film and configured to form a nip portion between the film and the pressure roller;

a heat conducting member that is in contact with the second surface of the heater; and a support member configured to support the heater and the heat conducting member, wherein the film is rotatable along the support member, wherein the film is held by the heater and the pressure roller therebetween, and an image on a printing material is heated at the nip portion formed between the film and the pressure roller and via the film, wherein the heat conducting member includes a first portion in contact with the second surface of the heater and a second portion provided outside of the heater on an upstream side in a rotational direction of the film, wherein the second portion includes a contact portion in contact with the inner surface of the film, and the contact portion protrudes toward the pressure roller farther than the first surface of the heater as viewed in a longitudinal direction of the heater, wherein an end face of the second portion is disposed inside an end face of the film in the longitudinal direction, and wherein the support member extends to an outside of the end face of the second portion, and includes a support portion that supports the film on an outside of the end face of the second portion.

3. The fixing apparatus according to claim 2, wherein the support portion protrudes toward the film more than the contact portion of the second portion.

4. The fixing apparatus according to claim 1, further comprising:

a temperature sensor disposed in contact with the heat conducting member; and a control unit configured to control electric power to be supplied to the heater so as to cause temperature detected by the temperature sensor to reach a target temperature.

5. The fixing apparatus according to claim 1, wherein the second portion extends, outside an end of the heater in the rotational direction, from a portion extending in a direction from the second surface of the heater to the first surface in a direction away from the heater in the rotational direction of the film.

6. The fixing apparatus according to claim 1, wherein the second portion is disposed upstream from the heater, and wherein the heat conducting member further includes a third portion provided outside of the heater on a downstream side in the rotational direction of the film.

7. A fixing apparatus configured to heat a toner image to fix the toner image to a printing material, the apparatus comprising:

a tubular film;

an elongated plate-like heater including a first surface in contact with an inner surface of the film and a second surface opposite to the first surface;

a pressure roller in contact with an outer periphery of the film and configured to form a nip portion between the film and the pressure roller;

a heat conducting member that is in contact with the second surface of the heater; and a support member configured to support the heater and the heat conducting member, wherein the film is rotatable along the support member, wherein the film is held by the heater and the pressure roller therebetween, and an image on a printing material is heated at the nip portion formed between the film and the pressure roller and via the film, wherein the heat conducting member includes a first portion in contact with the second surface of the heater and a second portion provided outside of the heater on a downstream side in a rotational direction of the film, wherein the second portion includes a contact portion in contact with the inner surface of the film, and the contact portion protrudes toward the pressure roller farther than the first surface of the heater as viewed in a longitudinal direction of the heater, and wherein the support member includes a restricting portion provided outside of the second portion on the downstream side, and the restricting portion protruding more than the second portion toward the pressure roller.

8. The fixing apparatus configured to heat a toner image to fix the toner image to a printing material, the apparatus comprising:

a tubular film;

an elongated plate-like heater including a first surface in contact with an inner surface of the film and a second surface opposite to the first surface;

a pressure roller in contact with an outer periphery of the film and configured to form a nip portion between the film and the pressure roller;

a heat conducting member that is in contact with the second surface of the heater; and a support member configured to support the heater and the heat conducting member, wherein the film is rotatable along the support member, wherein the film is held by the heater and the pressure roller therebetween, and an image on a printing material is heated at the nip portion formed between the film and the pressure roller and via the film, wherein the heat conducting member includes a first portion in contact with the second surface of the heater and a second portion provided outside of the heater on a downstream side in a rotational direction of the film, wherein the second portion includes a contact portion in contact with the inner surface of the film, and the contact portion protrudes toward the pressure roller farther than the first surface of the heater as viewed in a longitudinal direction of the heater, wherein an end face of the second portion is disposed inside an end face of the film in the longitudinal direction, and wherein the support member extends to an outside of the end face of the second portion, and includes a support portion that supports the film on an outside of the end face of the second portion.

9. The fixing apparatus according to claim 8, wherein the support portion protrudes toward the film more than the contact portion of the second portion.

10. The fixing apparatus according to claim 7, further comprising:

a temperature sensor disposed in contact with the heat conducting member; and a control unit configured to control electric power to be supplied to the heater so as to cause temperature detected by the temperature sensor to reach a target temperature.

11. The fixing apparatus according to claim 7, wherein the second portion extends, outside an end of the heater in the rotational direction, from a portion extending in a direction from the second surface of the heater to the first surface in a direction away from the heater in the rotational direction of the film.

* * * * *